United States Patent [19]

Johnson

[11] Patent Number: 4,712,518

[45] Date of Patent: Dec. 15, 1987

[54] POWER OUTPUT MECHANISM FOR AN INTERNAL COMBUSTION ENGINE

[75] Inventor: Fred L. Johnson, New Bern, N.C.

[73] Assignees: R. L. Thomas; W. J. Rouse, both of New Bern, N.C. ; a part interest

[21] Appl. No.: 789,018

[22] Filed: Oct. 18, 1985

[51] Int. Cl.[4] ..... F02B 75/32

[52] U.S. Cl. ..... 123/48 B; 123/54 R; 123/197 AC

[58] Field of Search ..... 123/197 R, 197 A, 197 AB, 123/197 AC, 195 R, 54, 78 R, 78 B, 48 R, 48 B

[56] References Cited

U.S. PATENT DOCUMENTS

| | | | |
|---|---|---|---|
| 286,900 | 10/1883 | Burke | 74/37 |
| 670,997 | 4/1901 | McLean | 123/197 R |
| 919,103 | 4/1909 | Whitehead | 123/197 R |
| 1,097,333 | 5/1914 | Kinmont et al. | 74/37 |
| 1,128,540 | 2/1915 | Spiess | 123/197 R |
| 1,369,445 | 2/1921 | Kruse | 123/197 R |
| 1,510,677 | 10/1924 | Jory | 123/197 AC |
| 1,528,002 | 3/1925 | Wolf | 123/54 R |
| 2,130,529 | 9/1938 | Filicky | 123/197 R |
| 2,920,210 | 1/1960 | May | 123/195 R |
| 3,673,876 | 7/1972 | Rohner | 74/37 |
| 3,861,239 | 1/1975 | McWhorter | 123/197 AC |
| 4,211,190 | 7/1980 | Indech | 123/48 B |
| 4,363,299 | 12/1982 | Bristol | 123/54 R |
| 4,465,042 | 8/1984 | Bristol | 123/197 R |
| 4,466,403 | 8/1984 | Menton | 123/197 R |

*Primary Examiner*—Craig R. Feinberg
*Attorney, Agent, or Firm*—Bacon and Thomas

[57] ABSTRACT

The present invention relates to an apparatus for converting between reciprocating motion and rotational motion, and particularly involves such an apparatus used as a power output mechanism for an internal combustion engine. The end of a piston rod is connected to a cam device which follows a closed loop path defined by a cam track. The closed loop path includes a pair of generally parallel, substantially straight portions. The substantially straight portions of the closed loop path are disposed at an angle of greater than 90°, but less than 180° to the longitudinal axis of the cylinder in which the piston travels.

25 Claims, 8 Drawing Figures

5
5
52b
74b
52a
74a
54b
54a
40b
40a
44b
44a
46b
46a
46
122
124
114
70
70
98a
152
128a
104
128b
78
131
129
144
144
110
134
130
136
146
138
110
58
118
149
140
146
112
138
142
98b
132
80
82
142
84
87
90
86
160
154
162
158
124
156
126
122

140

150
84
106
98b
148
99
82
118
76a
76
104
79
102
78
80
110
87
110
108
58
88
92

POWER OUTPUT MECHANISM FOR AN INTERNAL COMBUSTION ENGINE

FIELD OF THE INVENTION

The present invention relates to an improved power output mechanism for an internal combustion engine. More particularly, the invention relates to such a mechanism wherein the standard crankshaft is eliminated.

BRIEF DESCRIPTION OF THE PRIOR ART

Despite the long history, and continued refinement and development of the internal combustion engine, its basic mechanism for converting reciprocating motion to rotary motion has, for the most part, included a crankshaft rotatably mounted in the engine block having connecting rods attached between the reciprocating piston and each of the crankshaft throws. Thus, as the piston reciprocates, the crankshaft is rotated to provide the power output.

Typically, the piston is caused to rotate within its cylinder by the combustion of a fuel/air mixture within the cylinder. The expansion of the gases acts on one side of the piston, thereby exerting a rotative force on the crankshaft through its connection with the connecting rod. The peak pressures within the cylinder are not generated when the effective moment arm between the piston and the crankshaft is at a maximum. Usually, the combustion of the fuel/air mixture occurs a slightly after the piston has reached its top dead center (TDC) position. In this position, the crankshaft throw is slightly past the vertical and, therefore, its moment arm (i.e., the lateral distance between its connection with the connecting rod and its center of rotation) is not at its maximum. As the piston travels downwardly, the moment arm of the crankshaft reaches a maximum when the throw is horizontal which occurs when the piston is approximately halfway through its full stroke. However, as the piston travels downwardly, the volume in the combustion chamber expands, thereby reducing the pressures acting on the piston face.

Various attempts have been made over the years to replace the crankshaft with a more efficient mechanism. Such mechanisms include a cam guide means contacting the lower end of the connecting rod so as to direct the connecting rod end along a generally vertically elongated closed path. In order to maximize the torque output of such a mechanism, one of the runs of the closed loop path is disposed generally coincident with the axis of the piston and cylinder. Thus, during the power stroke, the connecting rod is generally coincidental with the longitudinal axis and travels along generally a straight line. The end of the connecting rod may drive a rotating output shaft via a cam or endless loop drive means. In order for these devices to achieve their desired goal of maximizing the torque output, the major axis of the closed loop path must be parallel to the longitudinal axis of the cylinder. This eliminates all forces during the power stroke other than those acting directly along the axis of the cylinder.

SUMMARY OF THE INVENTION

The present invention relates to an apparatus for converting between reciprocating motion and rotational motion, and particularly involves such an apparatus used as a power output mechanism for an internal combustion engine. The end of a piston rod is connected to a cam device which follows a closed loop path defined by a cam track. The closed loop path includes a pair of generally parallel, substantially straight portions. The substantially straight portions of the closed loop path are disposed at an angle of greater than 90°, but less than 180° to the longitudinal axis of the cylinder in which the piston travels.

The power is taken from the reciprocating piston by also attaching the end of the connecting rod to a closed loop drive means which is generally coincident with the closed loop path defined by the cam track. The closed loop drive means passes about a drive wheel and an idler wheel at its end portions. A line connecting the centers of the drive and idler wheels is disposed at an angle of greater than 90°, but less than 180° with respect to the longitudinal axis of the cylinder. The drive wheel is connected to an output shaft, such as through interengaging gears to provide the power output.

In cases where the internal combustion engine is a four-cycle engine, a pair of pistons are attached to each connecting rod. The pistons are oriented substantially parallel to each other and operate in adjacent, separate cylinders. Means are also provided to introduce a fuel/air mixture into the cylinders, to ignite the mixture and to exhaust the burned gases. The paired pistons operate such that each piston fires alternately. Thus, as the first piston undergoes its power stroke, its adjacent, connected piston is undergoing the intake portion of the cycle. As the pair of pistons pass the bottom dead center (BDC) position, the first piston undergoes an exhaust stroke, while the second undergoes its compression stroke. The fuel/air mixture in the second cylinder is ignited and as the pistons travel downwardly, the first cylinder undergoes its intake stroke. This alternate firing of the pistons serves to impart a smooth power motion to the drive mechanism. To provide the desired balance and smoothness of operation, a four-cycle engine should include two such pairs of pistons.

Although any form of closed loop, drive belt means can be utilized with the invention, it is envisioned that it will comprise an endless chain passing about a drive sprocket wheel and an idler sprocket wheel. The invention also envisions means to automatically adjust and maintain a specified tension on the chain and to take up any slack in the chain drive which may occur during the usages of the device.

DETAILED DESCRIPTION OF THE PREFERRED EMBODIMENT

Figure 1:
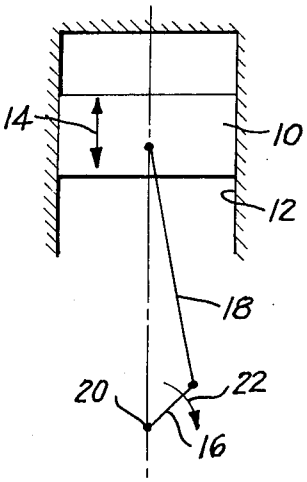
FIG. 1 PRIOR ART
FIG. 1 is a schematic diagram showing the reciprocating piston and crank mechanism of the prior art.

FIG. 1 shows a schematic diagram which illustrates the typical reciprocating piston/rotating crankshaft mechanism. Piston 10 reciprocates in cylinder 12 in the direction of arrow 14 and is connected to crank arm 16 by connecting rod 18. As is well known in the art, connecting rod 18 is pivotally attached to piston 10 and to the crank arm 16 such that, as piston 10 reciprocates, crank arm 16 rotates about axis 20 in the direction of arrow 22.

Figure 2:
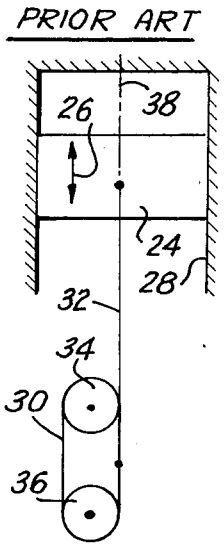
FIG. 2 is a schematic diagram of a reciprocating piston and an endless belt drive system according to the prior art.

A known device for replacing the crankshaft is schematically illustrated in FIG. 2. As can be seen, piston 24 reciprocates in the direction of arrow 26 within cylinder 28. Piston 24 is connected to endless drive means 30 by connecting rod 32. Endless drive means 30 passes around sprocket wheels 34 and 36, respectively, and is located such that one of the straight runs of the closed loop path is aligned with the longitudinal axis 38. Although this mechanism serves to maximize the torque output, the variations in piston speed, inherent in the crank device shown in FIG. 1, are still present. The output from the closed loop drive means is accomplished by attaching a drive gear to a shaft rotated by either sprocket wheel 34 or 36. The drive gear may engage other gears to drive an output shaft.

Figure 3:
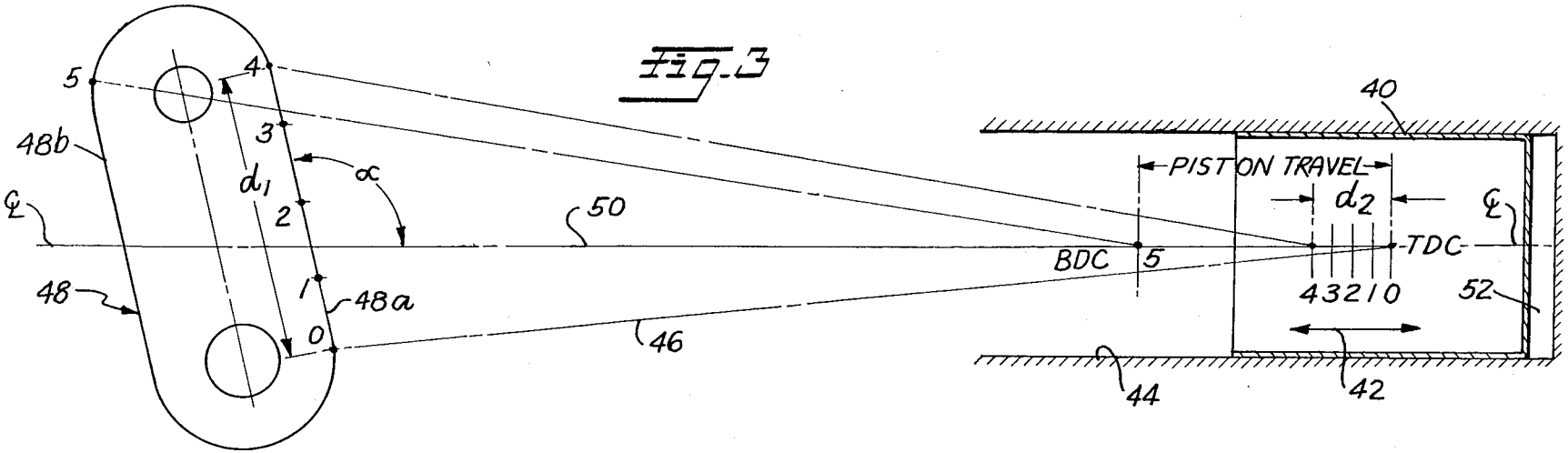
FIG. 3 is a schematic diagram showing the power output mechanism associated with a reciprocating piston according to the invention.

The mechanism according to the invention is schematically illustrated in FIG. 3. Piston 40 reciprocates in the direction of arrow 42 within cylinder 44. Connecting rod 46 has one end pivotally attached to piston 40, by any known means, while the other end extends from cylinder 44. The other end of piston rod 46 is constrained to move along a closed loop path 48 having a pair of generally parallel, substantially straight portions **48*a* and 48*b*, which are interconnected by curved end portions. Each of the substantially straight portions is disposed at an angle to the longitudinal axis 50 of the piston 40 and the cylinder 44**. Preferably this angle $\alpha$ is approximately 100°, but may be any angle greater than 90°, but less than 180°.

Figure 7:
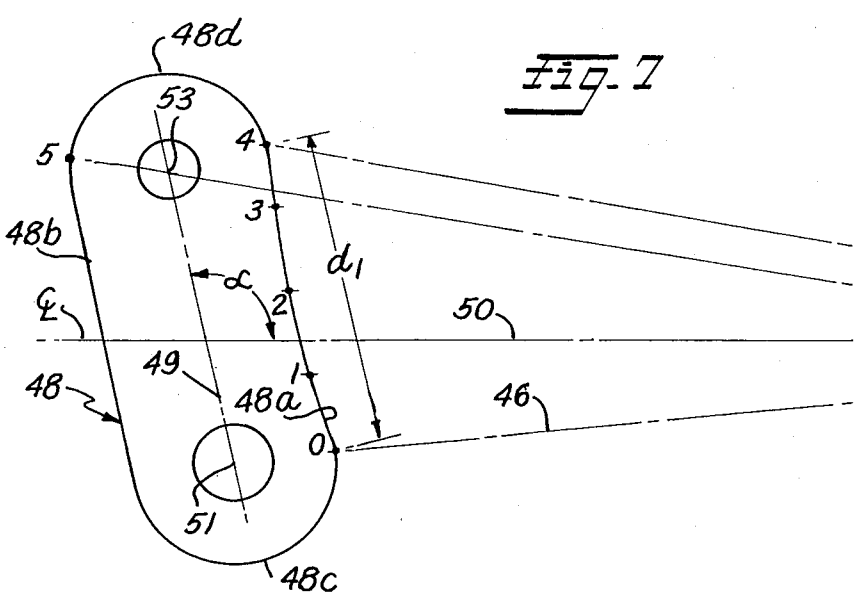
FIG. 7 is a partial schematic diagram showing a second embodiment of the power output mechanism according to the invention.

Alternatively, one or both of the substantially straight portions **48*a* and 48*b* may have a slight curvature as indicated in FIG. 7. In this embodiment, the line 49, which extends between the centers 51 and 53 of curved end portions 48*c* and 48*d*, is oriented at an angle $\alpha$ of approximately 100° to the longitudinal axis 50 of the piston 40 and cylinder 44. Angle $\alpha$ may be any angle greater than 90°, but less than 180°. The curvature of portion 48*a* is very slight, the distance between a line connecting the end points (shown at 0 and 4 in FIG. 4) and a parallel line tangent to the curve at point 2 being approximately ⅛" when the portion 48*a*** is approximately 3¾" in length.

It has been found that by orienting the substantially straight runs of the closed loop path at approximately 100°, the piston speed can be maintained substantially constant for a greater portion of its travel than in the prior art devices especially when portion **48*a*** is slightly curved as shown in FIG. 7. In the prior art devices, when a fuel/air mixture has been ignited it serves to accelerate the piston such that its speed increases rapidly. This promotes a rapid expansion of the combustion chamber and a rapid decrease in the pressure within the chamber. In the present invention, the piston speed is maintained constant for a longer period of time, thereby maintaining the pressures within the combustion chamber and promoting a more complete combustion of the fuel within the chamber.

The orientation of the closed loop path also serves to provide a greater output for a given amount of piston travel than the prior art devices. The piston 40 shown in FIG. 3 is at its uppermost or TDC position prior to the ignition of the fuel/air mixture in combustion chamber 52. At this point, connecting rod 46 is in the position shown in solid lines. This TDC position is indicated as number 0 on the piston and on the closed loop path portion **48*a*. Upon ignition of the fuel/air mixture in combustion chamber 52, the piston travels successively to positions 1, 2, 3, 4 and 5. The corresponding positions of the end of connecting rod 46 is illustrated by corresponding numbers on the closed loop path 48. It has been found that the speed of piston 40 remains substantially constant from the position 0 through position 4. In a piston having a stroke of 3.25" and a diameter of 3", it has been found that the speed of the piston will remain constant for approximately one inch of its travel. This is illustrated by the position 0 through 4. As the piston travels from position 0 to position 4, the opposite end of the connecting rod also travels from position 0 to position 4 along path 48*a*** to distance of $d_1$ as shown in FIGS. 3 and 7. As is clearly evident, this distance $d_1$ is significantly greater than the distance $d_2$ traveled by this piston during the same time period.

Figures 4, 8:
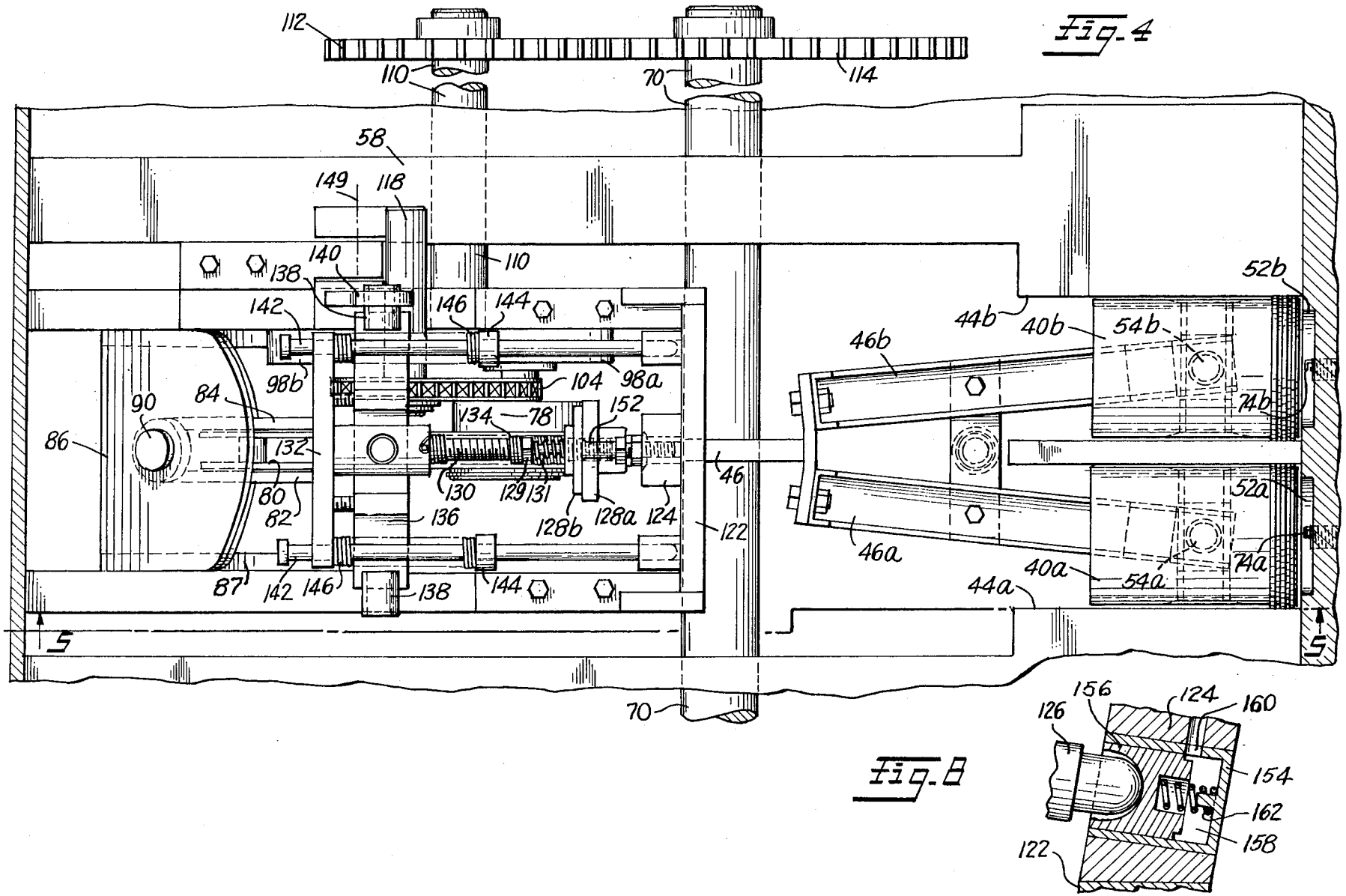
FIG. 4 is a partial, top sectional view taken along line 4—4 in FIG. 5 showing an internal combustion engine incorporating the power output mechanism according to the invention.
FIG. 8 is a partial sectional view showing an alternative embodiment of the bearing structure for the tension adjuster.
Figure 5:
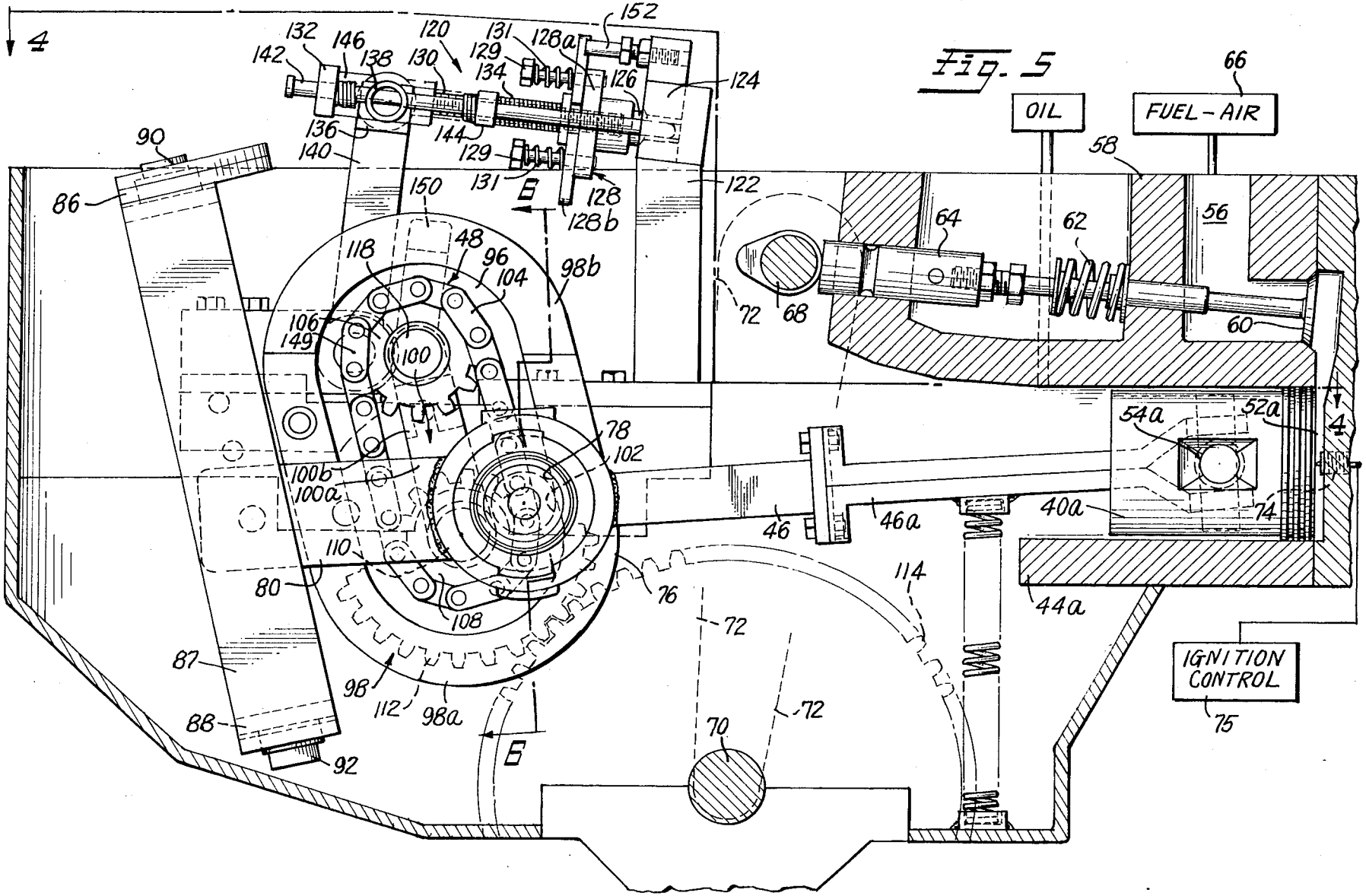
FIG. 5 is a partial, front sectional view taken along line 5—5 in FIG. 4 showing an internal combustion engine incorporating the mechanism according to the invention.
Figure 6:
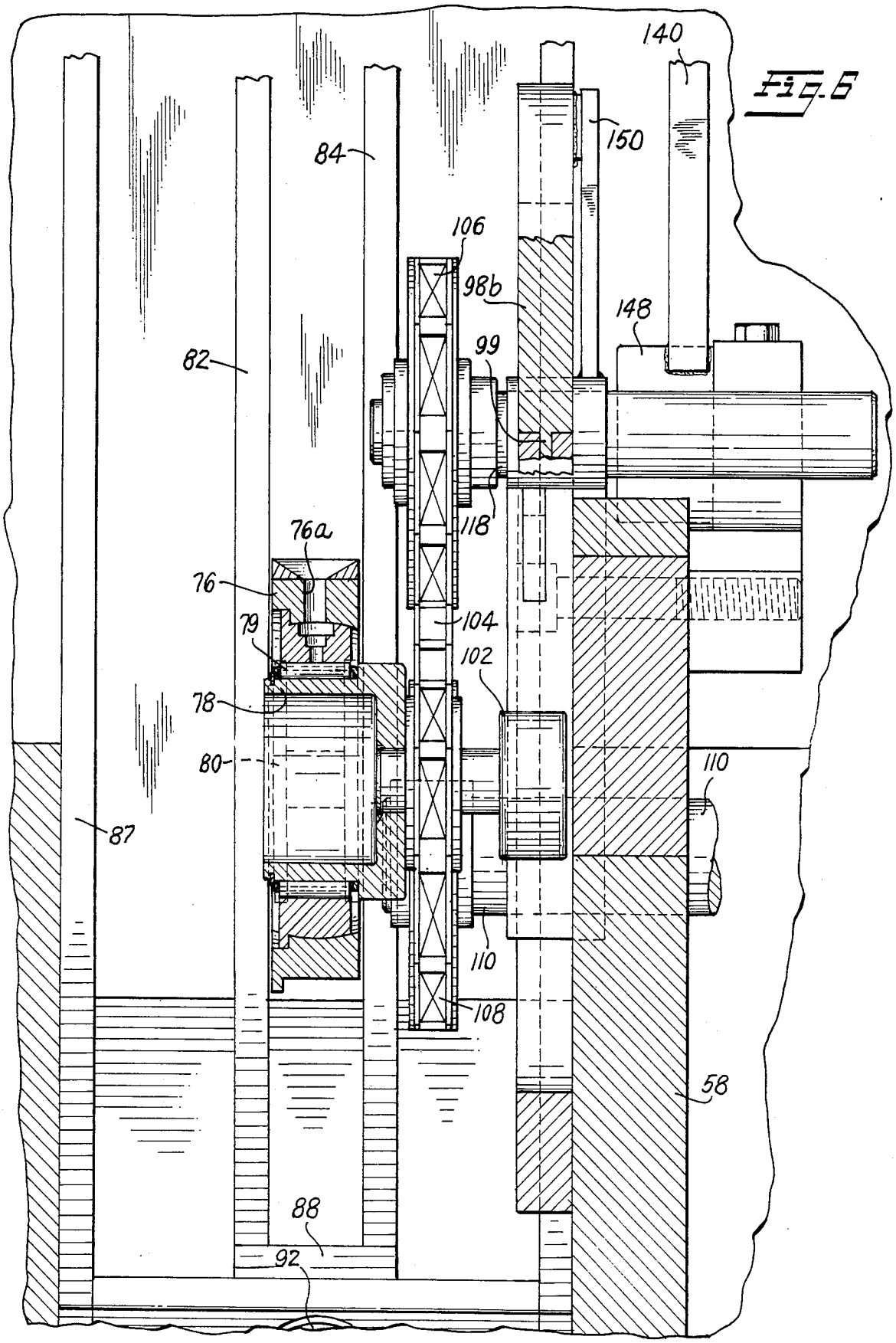
FIG. 6 is an enlarged, partial sectional view taken along line 6—6 in FIG. 5.

A four-cycle internal combustion engine embodying the mechanism according to the invention is shown in detail in FIGS. 4, 5 and 6. Although the invention will be described in terms of such an internal combustion engine, it is to be understood that the mechanism could be utilized with any device which converts reciprocating motion into rotating motion and vice versa. The invention may also be utilized with a two-cycle internal combustion engine which would obviate the use of paired pistons attached to each of the connecting rods. Thus, in a two-cycle engine, only a single piston need be connected to each of the connecting rods.

The four-cycle engine according to the invention utilizes a pair of pistons attached to each connecting rod in order to provide a smoother power input into the device. As seen in FIG. 4, pistons **40*a* and 40*b* reciprocate in adjacent cylinders 44*a* and 44*b*, respectively. The pistons 40*a* and 40*b* are connected to connecting rod 46 via connecting rod portions 46*a* and 46*b*, respectively. Rod portions 46*a* and 46*b* are attached to pistons 40*a* and 40*b* by universal joint connecting means 54*a* and 54*b***.

A fuel/air mixture is introduced into combustion chambers 52 from known fuel/air mixing means 66 via intake passage 56 defined in engine block 58 and controlled by intake valve 60. Lubrication for the pistons is provided by known oil supply means 59 through oil passages, such as at 61. Intake valve 60 is controlled in a known fashion by valve spring 62, valve lifter 64 and rotating cam 68. Cam 68 may be driven from output shaft 70 by known belt or chain means 72. An exhaust valve (not shown) is located adjacent to intake valve 60 to selectively allow the burned exhaust gases to pass through an exhaust opening (not shown) in block 58 to an exhaust manifold (not shown). The structure and operation of the intake and exhaust valves is in accordance with known principles, and the structures of these devices do not, per se, form a part of the instant invention.

Each of the cylinders 44a and 44b will have their own intake and exhaust valves which are controlled by rotating cam shaft 68. In order to provide a smooth power input to the drive mechanism, the valves are timed so as to alternately introduce a fuel/air mixture into combustion chamber 52a and 52b. From the positions of the pistons shown in FIGS. 4 and 5, it will be assumed that a fuel/air mixture has been introduced into chamber 52a and that intake valve 60 has closed. Thus, as the pistons 40a and 40b pass their TDC positions, the fuel/air mixture in combustion chamber 52a will be ignited by ignition means 74a, which may be a sparkplug or the like, controlled in a known manner by ignition control means 75. The expansion of the combustion gases in chamber 52a forces the pistons toward the left as seen in FIGS. 4 and 5. As piston 40b moves in this direction, its intake valve will open and a fuel/air mixture will be drawn into combustion chamber 52b.

As the pistons pass their BDC positions, the exhaust valve associated with combustion chamber 52a will open and both intake and exhause valves associated with chamber 52b will be closed. As the pistons move toward the right, the burnt combustion gases in chamber 52a will be exhausted through its exhaust valve, while the fuel/air mixture in combustion chamber 52b will be undergoing compression. As the pistons pass their TDC positions, the fuel/air mixture in chamber 52b will be ignited by ignition means 74b and the intake valve 60 associated with combustion chamber 52a will open to allow a fresh fuel/air mixture to be drawn into chamber 52a. This mixture will be drawn into chamber 52a as piston 40a moves to the left due to the expansion of the combustion gases in chamber 52b.

The end of connecting rod 46 has enlarged housing portion 76 formed thereon which extends around, and is mounted to, connecting shaft 78. Roller bearings 79 may be interposed between enlarged housing 76 and connecting shaft 78 to minimize the friction as the end of the connecting rod travels about its closed loop path. Lubricating passage 76a may be formed in enlarged housing 76 to provide lubricant to the roller bearings. A pilot plate 80 is attached to the enlarged housing 76 and extends generally in the direction of the connecting rod 46. The distal end of pilot plate 80 slidably extends in a pilot guide slot defined between pilot guide members 82 and 84. Pilot guide members 82 and 84 are attached to pilot structure end plates 86 and 88 by pilot shafts 90 and 92 which extend through holes in the pilot guide plates 86 and 88. Thus, the pilot guide members 82 and 84 restrict the movement of the end of connecting rod 46 to a generally vertical plane as the pilot plate 80 slides between them. End plates 86 and 88 are interconnected by side plates 87 and 89.

Compression spring 91 extends between bracket 93, attached to connecting rods 46a and 46b, and bracket 95 attached to a lower portion of the engine, as shown in FIGS. 4 and 5. The strength of compression spring 91 is such that its upward force partially compensates for the weight of the pistons and connecting rods so as to prevent an undue amount of wear on the lower sides of the pistons and cylinders.

The closed loop path 48 is determined by a cam track 96 defined between outer cam member 98 and inner cam member 100. Cam follower 102 is attached to connecting shaft 78 and is located so as to ride in the cam track 96 and follow the closed loop path 48. As can be seen, the reciprocating motions of pistons 40a and 40b cause the end of connecting rod 46 attached to the cam follower 102 to follow the closed loop path defined by the cam track 96. As discussed previously, the substantially straight portions 48a and 48b of the closed loop path are disposed at an angle $\alpha$ of approximately 100° with respect to the longitudinal axis of the pistons and cylinders. However, this angle may be any angle between an angle greater than 90° or less than 180° without exceeding the scope of this invention.

Connecting shaft 78 is also connected to closed loop drive means 104. Closed loop drive means 104 is illustrated as being a closed loop drive chain, but a closed loop belt, or other means may be substituted therefore. Drive chain 104 passes around idler sprocket wheel 106 and drive sprocket wheel 108 which are rotatably attached to the inner cam member 100. The chain passes around the sprocket wheels and generally follows a path coincident with closed loop path 48. Drive sprocket wheel 108 is attached to stub shaft 110 which extends through the inner cam track 100 and is rotatably supported by engine block structure 58. The opposite end of stub shaft 110 has gear 112 attached thereto so as to rotate with the stub shaft. Gear 112 engages gear 114 mounted on the output shaft 70. The particular number of gear teeth for the various sprocket wheels and gears as well as their diameters may be suitably chosen to provide the output desired according to the power requirements of the engine.

The outer cam track member 98 has a stationary lower portion 98a and an upper portion 98b which is movable with respect to the lower portion 98a in a direction generally parallel to the substantially straight portions of the cam track 96. Upper portion 98b may have tongue 99 extending therefrom which engages a correspondingly shaped groove in lower portion 98a. The tongue and groove allow relative movement between the portions, while acting as a guide means to keep the two portions generally coplanar. Similarly, the inner cam track member 100 comprises a stationary lower portion 100a and an upper, movable portion 100b which is slidably attached to the stationary portion. A similar tongue and groove connection may be utilized between upper portion 100b and lower portion 100a. Again, the movable portion 100b is movable along a direction generally parallel to the substantially straight portions of cam track 96. Idler sprocket wheel 106 is rotatably attached to the movable portion 100b by support shaft 118. Any stretching or elongation of the drive chain 104 may be taken up by moving upper portion 100b of inner cam track member 100, with the associated idler sprocket wheel 106, and upper portion 98b of outer cam track member 98 in a direction generally parallel to the straight portions of the cam track 96.

In order to accomplish this slack take up and to maintain a predetermined tension in the drive chain 104, tension adjusting means 120 is provided. Tension adjusting means 120 comprises a stationary support structure 122 mounted to engine block 58 having a bearing structure 124 attached to its upper, central portion. Bearing structure 124 defines a generally cylindrical opening into which the bearing portion 126 of rotatable tension member 128 is rotatably received. Rotatable tension member 128 comprises portion 128a threadingly engaged onto elongated threaded member 130, which has head portion 132 attached thereto. Tension member stop 128b is attached to portion 128a via bolts 129. Stop 128*b* is maintained against portion 128*a* by the force exerted thereon by springs 131. Tension stop member 128*b* has a hole extending through its central portion of a larger diameter than the threaded member 130. Thus, tension stop member 128*b* may be slightly axially displaced with respect to tension member portion 128*a* as the tension member 128 rotates. The displacement may be effected by contact between tension stop member 128*b* and stop 152. Torsion spring 134 is interposed between the threaded member and the rotatable tension member tending to unthread the rotatable tension member from the elongated threaded member 130.

Head portion 132 is pivotally attached to cross member 136 which has end portions 138 extending from either end so as to engage an opening in the upper portion of arm 140. Tension guide rods 142 extend through lateral extremities of head portion 132 and have their ends attached to stationary structure 122. Each of the guide rods 142 has a collar 144 attached thereto and a compression spring 146 interposed between the collar and the lateral extremities of head portion 132.

Arm 140 is connected to pivot body 148 which pivots about an axis generally parallel to the axis of rotation of the idler sprocket wheel 106. The support shaft 118 for idler sprocket 106 is rotatably supported within the pivot body 148 such that the pivot axis 149 of the pivot body 148 is offset with respect to the axis of rotation of the idler sprocket wheel 106. A second arm 150 interconnects the pivot body 148 to the movable, upper portion of the outer cam track guide 98*b*. Thus, as can be seen from FIGS. 4, 5 and 6, the compression springs 146 exert a force toward the left (in FIGS. 4 and 5) on head portion 132 and, consequently, cross member 136 of the tension adjusting means. This force tends to pivot arm 140 in a counterclockwise direction about the pivot axis 149 of pivot body 148. Since the idler sprocket wheel 106 and its support shaft 118 are supported on this pivot body, they also tend to move about the pivot axis 149 in a counterclockwise direction as seen in FIG. 5. This maintains a tension in the drive chain 104 which is determined by the force of springs 146 and the geometry of the various arms and pivots.

The tensioning force also serves to adjust the position of the movable cam track elements 98*b* (via arm 150) and 100*b* to insure that the closed loop path 48 is adjusted simultaneously with the chain tension.

Stationary support structure 122 has stop member 152 attached thereto which extends into the path of rotatable tension member 128. When the tension in the chain is properly adjusted, stop 152 prevents rotating motion of rotatable tension member 128. When a significant amount of slack develops in chain 104 the compression springs 146 will move head member 132 and the elongated threaded member 130 toward the left as shown in FIGS. 4 and 5. This will remove rotatable tension member 128 from contact with the stop 152 and allow it to rotate, due to the action of the torsion spring 134, until it once again contacts the stop member 152. This effectively increases the distance between the upper end of arm 140 and the bearing member 124 of the stationary support structure 122 so as to maintain tension on the elongated drive chain 104. Additional stops similar to stop 152 may be provided circumferentially displaced around the axis of rotation of tension member 128 and extending into the path of its rotation. The longitudinal position of stop member 152 may be adjusted with respect to tension member 128 by a threaded engagement of stop member 152 with support structure 122.

An alternative bearing structure 124 is shown in FIG. 8. Cylinder 154 is mounted on support structure 122 and has bearing piston 156 slidably mounted therein. Piston 156 has a recessed outer portion to accommodate bearing portion 126 as shown. Oil is supplied to chamber 158 through passage 160 by known oil supply means. The oil serves a cushioning effect when compressed as piston 156 moves toward the end of cylinder 154. Spring 162 is a compression spring and is interposed between piston 156 and cylinder 154. A ballcheck valve (not shown) may be incorporated into the end of cylinder 154 to prevent any possibility of a vacuum lock occurring between the piston and the cylinder.

The foregoing description is provided for illustrative purposes only and should not be construed as in any way limiting the invention, the scope of which is defined solely by the appended claims.

What is claimed is:

1. Apparatus for converting between reciprocating movement and rotational movement comprising:
   (a) a member constrained so as to undergo reciprocating movement along a first axis between a top dead center position and a bottom dead center position;
   (b) an output shaft mounted so as to undergo rotational movement about its longitudinal axis; p1 (c) a connecting rod having a first end attached to the member and a second end;
   (d) guide means attached to the second end of the connecting rod to constrain the second end to move in a closed loop path, the guide means comprising:
      (i) means defining a cam track forming the closed loop path, the cam track including the pair of generally parallel, substantially straight portions disposed at an angle of greater than 90°, but less than 180° to the first axis, and, a first portion movable with respect to a second portion so as to vary the length of the closed loop path; and,
      (ii) a cam follower attached to the second end of the connecting rod and extending into the cam track so as to constrain the second end to follow the closed loop path defined by the cam track;
   (e) driving means interconnecting the second end of the connecting rod and the output shaft so as to cause the output shaft to rotate as the second end travels along the closed loop path, the drive means including a closed loop drive member; and,
   (f) means to move the first portion of the cam track with respect to the second portion so as to vary the length of the closed loop path and to maintain a predetermined tension on the closed loop drive member.

2. The apparatus according to claim 1 wherein the driving means comprises:
   (a) a first, drive wheel;
   (b) means drivingly connecting the first, drive wheel to the output shaft;
   (c) a second, idler wheel, the closed loop drive member passing around a portion of the drive and idler wheels; and,
   (d) attaching means attaching the closed loop drive member to the second end of the connecting rod.

3. The apparatus according to claim 2 wherein the first, drive wheel and the second, idler wheel comprise sprocket wheels and the closed loop drive member comprises an endless chain engaging the sprocket wheels.

4. The apparatus according to claim 3 wherein the means drivingly connecting the first, drive wheel to the output shaft comprises:

(a) a stub shaft connected to the first, drive sprocket wheel so as to rotate therewith;

(b) a first gear attached to the stub shaft so as to rotate therewith; and, (c) a second gear attached to the output shaft so as to rotate therewith, the second gear engaging the first gear.

5. The apparatus according to claim 3 wherein the means to maintain a predetermined tension on the closed loop drive member comprises:

(a) a pivot body adapted to pivot about a pivot axis generally parallel to the axis of rotation of the idler sprocket wheel;

(b) an axle rotatably supporting the idler sprocket wheel attached to the pivot body displaced from the pivot axis;

(c) a first extending from the pivot body; and, (d) means acting on the first arm so as to exert a pivoting force on the pivot body thereby urging the idler sprocket wheel against the endless chain.

6. The apparatus according to claim 5 further comprising a second arm interconnecting the first portion of the cam track with the axle supporting the idler sprocket wheel.

7. The apparatus according to claim 6 wherein the means acting on the first arm is adjustable so as to adjust the tension on the endless chain.

8. The apparatus according to claim 5 wherein the means acting on the first arm to exert a pivoting force thereon comprises:

(a) a threaded member having a first end attached to the arm;

(b) a stationary structure;

(c) a rotatable tension member threadingly engaged with the threaded member, the rotatable tension member having a bearing portion in contact with the stationary structure;

(d) a torsion spring interconnecting the threaded member and the rotatable tension member causing rotation thereof and consequent movement along the threaded member to increase the distance between the stationary structure and the threaded member; and, (e) stop means attached to the stationary structure so as to stop the rotation of the rotatable tension member at a predetermined point.

9. The apparatus according to claim 8 further comprising:

(a) a pilot plate attached to the second end of the connecting rod; and, (b) pilot structure defining a pilot guide slot so as to slidably receive the pilot plate, the pilot guide slot extending generally parallel to the plane of movement of the second end of the connecting rod.

10. An internal combustion engine comprising:

(a) cylinder block means defining at least one cylinder, the cylinder having a longitudinal axis and a closed end;

(b) a piston slidably mounted in the at least one cylinder;

(c) intake means to introduce a fuel/air mixture into the cylinder between the piston and the closed end of the cylinder;

(d) ignition means to ignite the fuel/air mixture within the cylinder;

(e) exhaust means to exhaust the burned fuel/air mixture from the cylinder;

(f) an output shaft rotatably mounted so as to rotate about its central axis;

(g) a connecting rod having a first end attached to the piston and a second end;

(h) guide means attached to the second end of the connecting rod to constrain the second end to move in a closed loop path, the guide means comprising:

(i) means defining a cam track forming the closed loop path, the cam track including the pair of generally parallel, substantially straight portions disposed at an angle of greater than 90°, but less than 180° to the first axis, and a first portion movable with respect to a second portion so as to vary the length of the closed loop path; and, (ii) a cam follower attached to the second end of the connecting rod and extending into the cam track so as to constrain the second end to follow the closed loop path defined by the cam track;

(i) driving means interconnecting the second end of the connecting rod and the output shaft so as to cause the output shaft to rotate as the second end travels along the closed loop path, the drive means including a closed loop drive member; and, (j) means to move the first portion of the cam track with respect to the second portion so as to vary the length of the closed loop path and to maintain a predetermined tension on the closed loop drive member.

11. The internal combustion engine according to claim 10 wherein the engine is a two-cycle internal combustion engine.

12. The internal combustion engine according to claim 10 wherein the cylinder block defines at least a pair of adjacent cylinders, the longitudinal axes of which are generally parallel, each cylinder having a closed end and wherein a piston is slidably mounted in each cylinder.

13. The internal combustion engine according to claim 12 wherein the connecting rod comprises:

(a) a first end portion attached to both pistons mounted in the pair of cylinders; and, (b) a second end portion attached to the guide means.

14. The internal combustion engine according to claim 13 wherein the intake means alternately introduces a fuel/air mixture into each of the pair of adjacent cylinders.

15. The internal combustion engine according to claim 14 wherein the ignition means alternately ignites the fuel/air mixture in each of the pair of adjacent cylinders.

16. The internal combustion engine according to claim 15 wherein the exhaust means alternately exhausts the burned fuel/air mixture from each of the pair of adjacent cylinders.

17. The internal combustion engine according to claim 16 wherein the engine is a four-cycle internal combustion engine.

18. The internal combustion engine according to claim 10 wherein the driving means comprises:

(a) a first, drive wheel;

(b) means connecting the first, drive wheel to the output shaft;

(c) a second, idler wheel, the closed loop drive member passing around a portion of the drive and idler wheels; and, (d) attaching means attaching the closed loop drive member to the second end of the connecting rod.

19. The internal combustion engine according to claim 18 wherein the first, drive wheel and the second, idler wheel each comprise sprocket wheels and the closed loop drive means comprises an endless chain engaging the sprocket wheels.

20. The internal combustion engine according to claim 19 wherein the means drivingly connecting the first, drive wheel to the output shaft comprises:

(a) a stub shaft connected to the first, drive sprocket wheel so as to rotate therewith;

(b) a first gear attached to the stub shaft so as to rotate therewith; and, (c) a second gear attached to the output shaft so as to rotate therewith, the second gear engaging the first gear.

21. The internal combustion engine according to claim 19 wherein the means to maintain a predetermined tension on the closed loop drive member comprises:

(a) a pivot body adapted to pivot about a pivot axis extending generally parallel to the axis of rotation of the second, idler sprocket wheel;

(b) an axle rotatably supporting the idler sprocket wheel attached to the pivot body displaced from the pivot axis;

(c) a first arm extending from the pivot body; and, (d) means acting on the first arm so as to exert a pivoting force on the pivot body thereby urging the idler sprocket against the endless chain.

22. The internal combustion engine according to claim 21 further comprising a second arm interconnecting the first portion of the cam track with the axle supporting the idler sprocket wheel.

23. The internal combustion engine according to claim 22 wherein the means acting on the first arm is adjustable so as to adjust the tension on the endless chain.

24. The internal combustion engine according to claim 23 wherein the means acting on the first arm to exert a pivoting force thereon comprises:

(a) a threaded member having a first end attached to the arm;

(b) a stationary structure;

(c) a rotatable tension member threadingly engaged with the threaded member, the rotatable tension member having a bearing portion in contact with the stationary structure;

(d) a torsion spring interconnecting the threaded member and the rotatable tension member so as to exert a rotative force on the rotatable tension member causing rotation thereof and consequent movement along the threaded member to increase the distance between the stationary structure and the threaded member; and, (e) stop means attached to the stationary structure so as to stop the rotation of the rotatable tension member at a predetermined point.

25. The internal combustion engine according to claim 24 further comprising:

(a) a pilot plate attached to the second end of the connecting rod; and (b) pilot structure defining a pilot guide slot which slidably receives the pilot plate, the pilot guide slot extending generally parallel to the plane of movement of the second end of the connecting rod.

* * * * *